US009995048B1

(12) United States Patent
Gamelin

(10) Patent No.: US 9,995,048 B1
(45) Date of Patent: Jun. 12, 2018

(54) HANDHELD CONCRETE FINISHER

(71) Applicant: Tery Gamelin, Wayland, MI (US)

(72) Inventor: Tery Gamelin, Wayland, MI (US)

( * ) Notice: Subject to any disclaimer, the term of this patent is extended or adjusted under 35 U.S.C. 154(b) by 434 days.

(21) Appl. No.: 14/689,619

(22) Filed: Apr. 17, 2015

Related U.S. Application Data

(60) Provisional application No. 61/980,831, filed on Apr. 17, 2014.

(51) Int. Cl.

| | |
|---|---|
| ***E04F 21/24*** | (2006.01) |
| ***E04F 21/16*** | (2006.01) |
| ***E04G 21/10*** | (2006.01) |
| ***E01C 19/44*** | (2006.01) |

(52) U.S. Cl.
CPC ..... *E04F 21/244* (2013.01); *E01C 19/44* (2013.01); *E04F 21/161* (2013.01); *E04F 21/162* (2013.01); *E04F 21/163* (2013.01); *E04F 21/24* (2013.01); *E04F 21/241* (2013.01); *E04G 21/10* (2013.01)

(58) Field of Classification Search
CPC ..... E04F 21/244; E04F 21/241; E04F 21/24; E04F 21/161; E04F 21/163; E04F 21/162; E01C 19/44; E04G 21/10
USPC ..... 15/235.4, 235.5, 235.8
See application file for complete search history.

(56) References Cited

U.S. PATENT DOCUMENTS

| | | | | |
|---|---|---|---|---|
| 2,155,571 | A * | 4/1939 | Tullis | E01C 19/44 15/235.8 |
| 3,090,984 | A * | 5/1963 | Dunnigan | E04F 21/06 15/235.4 |
| 4,800,609 | A * | 1/1989 | Peck | A47L 13/24 15/143.1 |
| 5,115,536 | A * | 5/1992 | Jarvis | B25G 3/38 15/144.1 |
| 5,632,569 | A * | 5/1997 | Szmansky | E04F 21/163 15/235.4 |
| 6,295,689 | B1 * | 10/2001 | Sciacca | B25G 1/06 15/143.1 |
| 6,298,744 | B1 | 10/2001 | Huang | |
| 7,223,038 | B2 * | 5/2007 | Livingstone | A47G 27/0487 401/138 |

* cited by examiner

*Primary Examiner* — Mark Spisich
*Assistant Examiner* — James Bauer
(74) *Attorney, Agent, or Firm* — Gardner, Linn, Burkhart and Ondersma, LLP

(57) ABSTRACT

A handheld concrete finisher is disclosed for finishing concrete from an upright or standing position. The concrete finisher includes a concrete finishing tool, a handle assembly, a multi-axis pivot assembly attached between the handle assembly and the concrete finishing tool, and a control mechanism that allows an operator to selectively prevent the handle assembly from pivoting or rotating about one of the pivot axes. The multi-axis pivot assembly allows the operator to pivot the handle assembly both side to side and backward and forward relative to the concrete finishing tool, and to prevent the handle assembly from rotating while still allowing the handle assembly to pivot side to side. The finishing tool is detachable and can be any one of a number of tools for preparing concrete, based on the job requirements. The handle assembly can be adjusted for the operator's height and/or to extend the operator's reach.

20 Claims, 4 Drawing Sheets

HANDHELD CONCRETE FINISHER

CROSS REFERENCE TO RELATED APPLICATION

The present application claims priority of U.S. provisional application Ser. No. 61/980,831 filed Apr. 17, 2014, by Tery Gamelin, which is hereby incorporated herein by reference in its entirety

FIELD OF THE INVENTION

The present invention relates generally to concrete finishing tools and, more particularly, to upright concrete finishing tools.

BACKGROUND OF THE INVENTION

Finishing concrete is a multi-step process involving repeatedly working the surface of the freshly poured concrete with various different handheld tools. Depending on the size of the job, this may require workers to be on their knees for long periods of time, and may also require workers to reposition themselves about the concrete to move various tools there over to obtain the desired surface finish.

SUMMARY OF THE INVENTION

The present invention provides a handheld concrete finisher for finishing concrete from an upright or standing position. The concrete finisher includes a concrete finishing tool, a handle assembly, a multi-axis pivot assembly attached between the handle assembly and the concrete finishing tool, and a control mechanism that allows an operator to selectively prevent the handle assembly from pivoting or rotating about one of the pivot axes. The multi-axis pivot assembly allows the operator to pivot the handle assembly both side to side and backward and forward relative to the concrete finishing tool. When the operator has found a desired working position, the operator may engage and disengage the control mechanism, preventing the handle assembly from rotating backward or forward relative to the finishing tool while still allowing the handle assembly to pivot side to side as the finishing tool moves across the surface of the concrete. The finishing tool can be any one of a number of tools for preparing concrete such as a float, trowel, edger or the like, and is detachable, allowing for an operator to interchange tool attachments based on the job requirements. The handle assembly is capable of extending or retracting to adjust to the height of the operator and/or to extend the reach of the operator.

These and other objects, advantages, purposes and features of the present invention will become more apparent upon review of the following specification in conjunction with the drawings.

DESCRIPTION OF THE PREFERRED EMBODIMENTS

Figure 1:
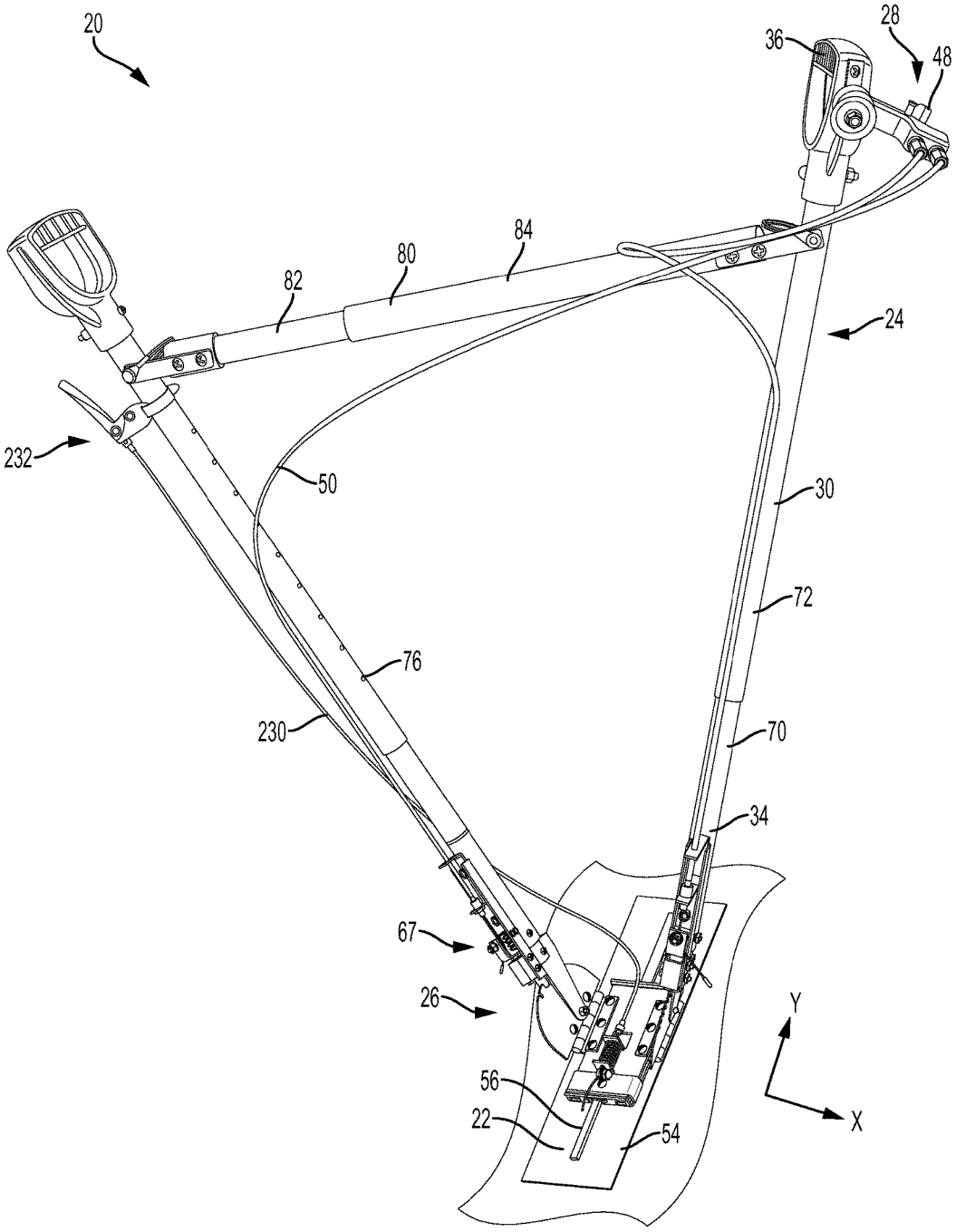
FIG. 1 is a perspective view of a handheld concrete finisher in accordance with the present invention.

Referring now to the drawings and the illustrative embodiments depicted therein, a handheld concrete finisher or concrete finisher assembly 20 as shown in FIGS. 1-4 comprises a detachable concrete finishing tool 22, a handle assembly 24, a pivot assembly 26, and a hinge plate assembly 200. As the operator works the concrete surface, the handle assembly 24 is moveable relative to tool 22 to maintain the tool 22 in a generally flat orientation against the concrete surface. Moreover, the handle assembly 24 allows the operator to comfortably stand while using finisher assembly 20, with the handle assembly 24 being adjustable in length to adjust the reach of the operator when using the finisher assembly 20. The finishing tool 22 is removable to enable alternative tools to be used with the finisher assembly 20, such as for alternative steps in the concrete finishing process.

When finishing concrete, it is desirable for the finishing tool 22 to remain generally flat against the concrete surface so that the finished surface is smooth. The pivot assembly 26 attaches between finishing tool 22 and handle assembly 24 and allows an operator to pivot handle assembly 24 both side-to-side and backward and forward relative to the finishing tool 22. Pivot assembly 26 allows handle assembly 24 to rotate about both the longitudinal length axis and side-to-side axis relative to finishing tool 22, providing the operator greater control over finishing tool 22. Butt hinges 44 (FIG. 2) provide a connection between finishing tool 22 and handle assembly 24. Hinges 44 allow handle assembly 24 to pivot side-to-side about a first axis (or Y axis) of finishing tool 22 as the operator moves finishing tool 22 over the surface of the concrete. As understood from FIGS. 2 and 4, one side of hinge 44 attaches to a tool bracket 46' via a plurality of fasteners, where tool bracket 46' is used to selectively engage with removable finishing tool 22, as discussed in more detail below. As also understood from FIGS. 2 and 4, the other side of hinge 44 attaches to a disc 42' via additional fasteners. Slotted handle assembly brackets 38 of handle assembly 24 are configured to receive respective discs 42' and dimensioned to attach to the discs 42' at generally the center of the disc 42' via a fastener 62. Fastener 62 allows handle assembly 24 to pivot backward and forward about discs 42', and thereby about a second axis (or X axis) relative to finishing tool 22.

A control mechanism 28 is provided that may be selectively engaged by the operator via a handle 48 to adjust the forward or backward positioning of handle assembly 24 about discs 42'. In particular, the operator inhibits handle assembly 24 from pivoting backward and forward relative to finishing tool 22 by engaging and disengaging control mechanism 28. A pair of spring loaded locking mechanisms 67 each have a retractable tab 68 configured to engage one of a plurality of notches 69 in the semicircular discs 42'. When the operator engages lever 48 of control mechanism 28, cable 50 retracts tabs 68 from their corresponding notches, allowing for backward and forward adjustment of handle assembly 24 about discs 42'. When the operator has selected the desired working position, the operator may release lever 48 so that each tab 68 engages one of the notches 69 on corresponding disc 42', preventing further backward and forward pivoting of handle assembly 24 relative to finishing tool 22. This enables the operator, for example, to maintain a desired orientation and apply force to finishing tool 22 while limiting the pivotal movement of handle assembly 24 relative to the finishing tool 22. Alternatively, finisher assembly 20 may be used with tabs 68 disengaged from notches 69 to allow full pivoting. It should also be appreciated that in the illustrated embodiment pivot assembly 26 will still allow side-to-side pivoting via hinges 44 regardless of whether tabs 68 are engaged with notches 69.

Finishing tool 22 includes an elongated and generally flat plate 54 and includes a rib 56 (FIG. 3) extending lengthwise atop plate 54 and, as previously noted, finishing tool 22 is attachable and detachable to finisher assembly 20. The illustrated embodiment of the handheld concrete finisher assembly 20 is configured to prepare concrete with different finishes by interchanging finishing tool 22 with hinge plate assembly 200. The plate assembly 200 includes a mounting plate or hinge plate 202, slider 210, the tool bracket 46', spring 216, tool release cable 230, and tool release lever 232. The mounting plate 202 is fastened to rib 56 of the finishing tool 22 by fasteners, welding, or the like. It should thus be appreciated that various different tools each with a mounting plate affixed thereto may be used with finisher assembly 20 by connecting the mounting plate 202 with the tool bracket 46'.

Figure 2:
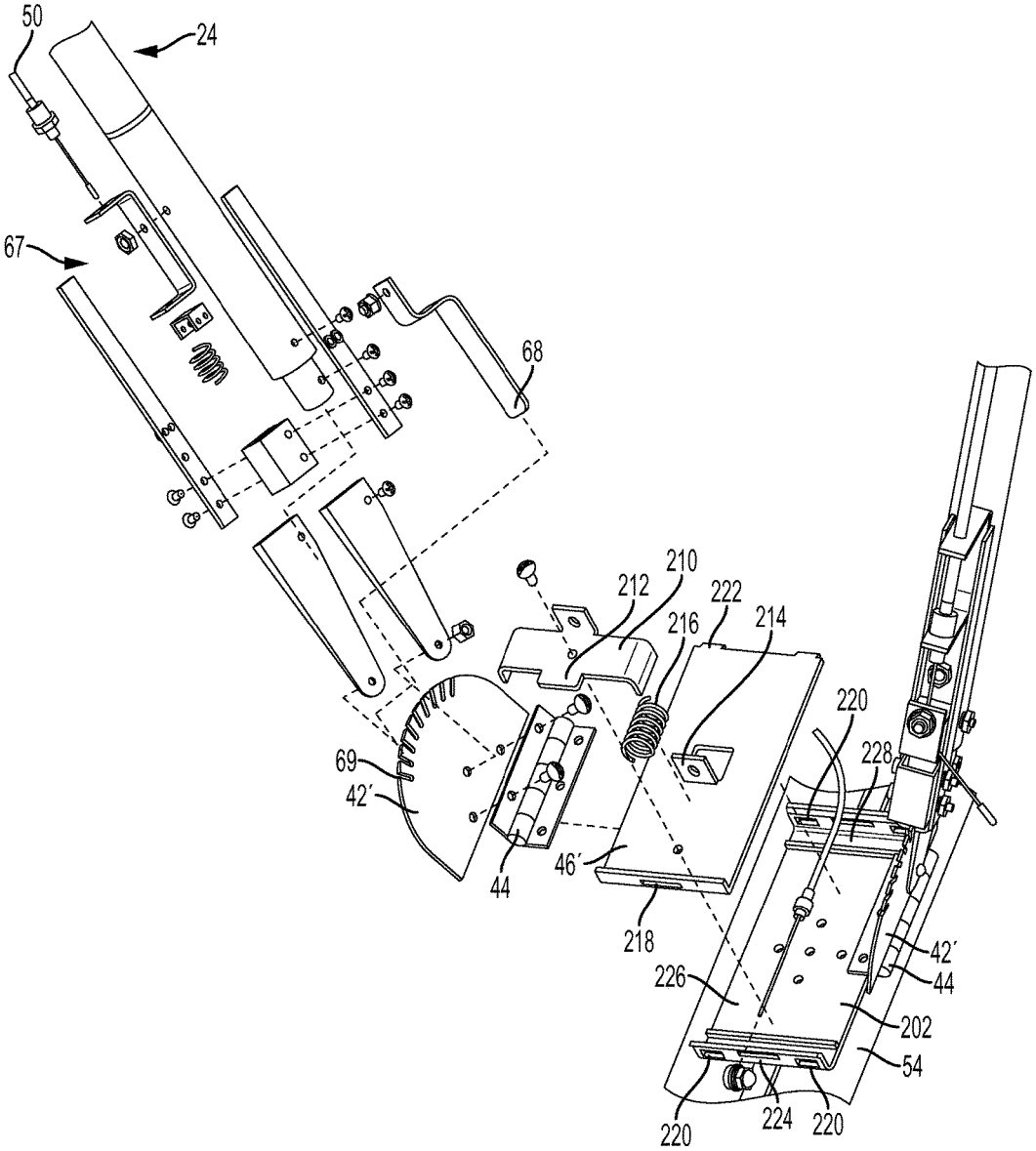
FIG. 2 is an exploded front perspective view of a pivot assembly of the handheld concrete finisher of FIG. 1.
Figure 3:
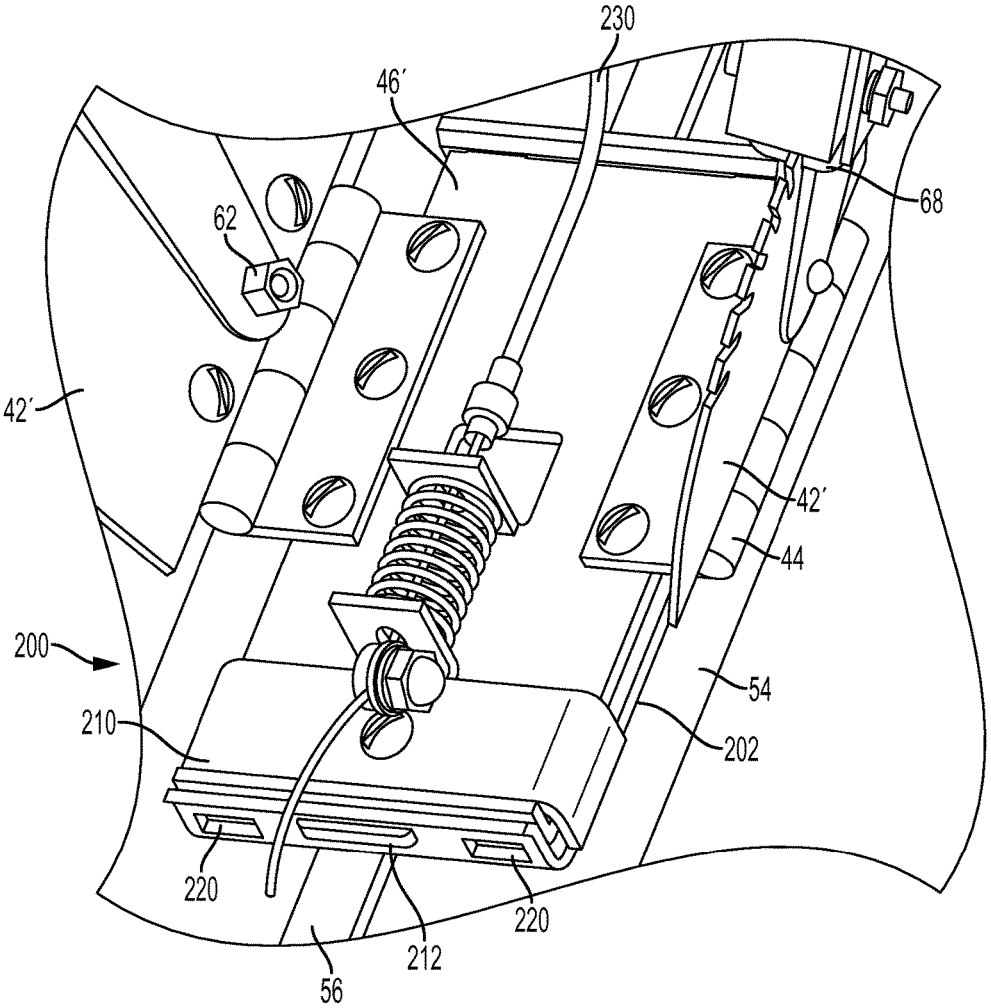
FIG. 3 is an enlarged perspective view of a hinge plate assembly of the pivot assembly of the handheld concrete finisher of FIG. 1.

As best shown in FIGS. 2-3, the mounting plate 202 is configured to receive tool bracket 46' by coupling a plurality of slots formed in the plate 202 with tabs of the tool bracket 46'. The illustrated embodiment shows the plate 202 having a rectangular shape and with vertical portions at the first end 226 and opposing second end 228. Each of the first end 226 and second end 228 has at least one tool tab slot 220, such as at each corner of the mounting plate 202. Each tab slot 220 is a generally rectangular aperture through the vertical portion of the mounting plate 202. Furthermore, the plate 202 has a slider or receiving slot 224 at each of the first end 226 and second end 228. Each slider slot 224 is generally a rectangular aperture through the vertical portion of the mounting plate 202.

The tool bracket 46' is shaped to substantially be received in mounting plate 202. The tool bracket 46' includes at least one tool bracket tab 222 on one end, and a slider slot 218 on an opposing end. The slider slot 218 has a substantially similar shape as the slider slot 224 of the mounting plate 202. In the illustrated embodiment, tool bracket 46' has two tabs 222 opposite the slider slot 218. The tabs 222 are disposed to engage the slots 220 of the first end 226 or the second end 228 of the mounting plate 202. Furthermore, when the tool bracket 46' is received in the mounting plate 202, the tool bracket slider slot 218 and the mounting plate slider slot 224 form a single aperture. The single aperture is configured to engage the slider tab 218 when the tool bracket 46' is received in the mounting plate 202 and the tool release lever 232 is disengaged. Furthermore, tool bracket 46' is reversibly receivable to mounting plate 202 relative to first end 226 and second end 228 because the slider slots 224 and tab slots 220 at the first end 226 are substantially similar, respectively, to those at the second end 228.

The tool release lever 232 is mounted to at least one of the hand grips 36 for operating the hinge plate assembly 200. Lever 232 is coupled to cable 230 that is further coupled to the hinge plate assembly 200. Specifically, cable 230 is coupled to the slider 210 of the hinge plate assembly 200 by a fastener. When an operator engages lever 232, cable 230 contracts to pull and disengage slider 210, specifically slider tab 212 from the mounting plate slider slot 224. Contracting cable 230 also compresses spring 216 against slider 210 and spring tab 214, which biases the slider tab 218 to return when the operator releases lever 232, where spring 216 normally biases tab 212 into engagement with slot 224 for retaining finishing tool 22 to finisher assembly 20. When the slider tab 212 is decoupled from slot 224 of mounting plate 202, the operator also decouples the tool bracket tabs 222 of the tool bracket 46' from the tool tab slots 220 of the mounting plate 202 by manipulating the assembly 20 with hand grips 36. When the tool bracket 46' is decoupled from the mounting plate 202, the operator may then couple the assembly 20 to another finishing tool (not shown) by engaging lever 232 to compress spring 216, manipulating the assembly 20 to another finishing tool, then coupling the tool bracket tabs 222 to mounting plate tool tab slots, and releasing lever 232 so the slider tab 212 engages with a slider slot of the new finishing tool. Thus, the assembly 20 allows the operator to quickly interchange from one finishing tool to another.

Figure 4:
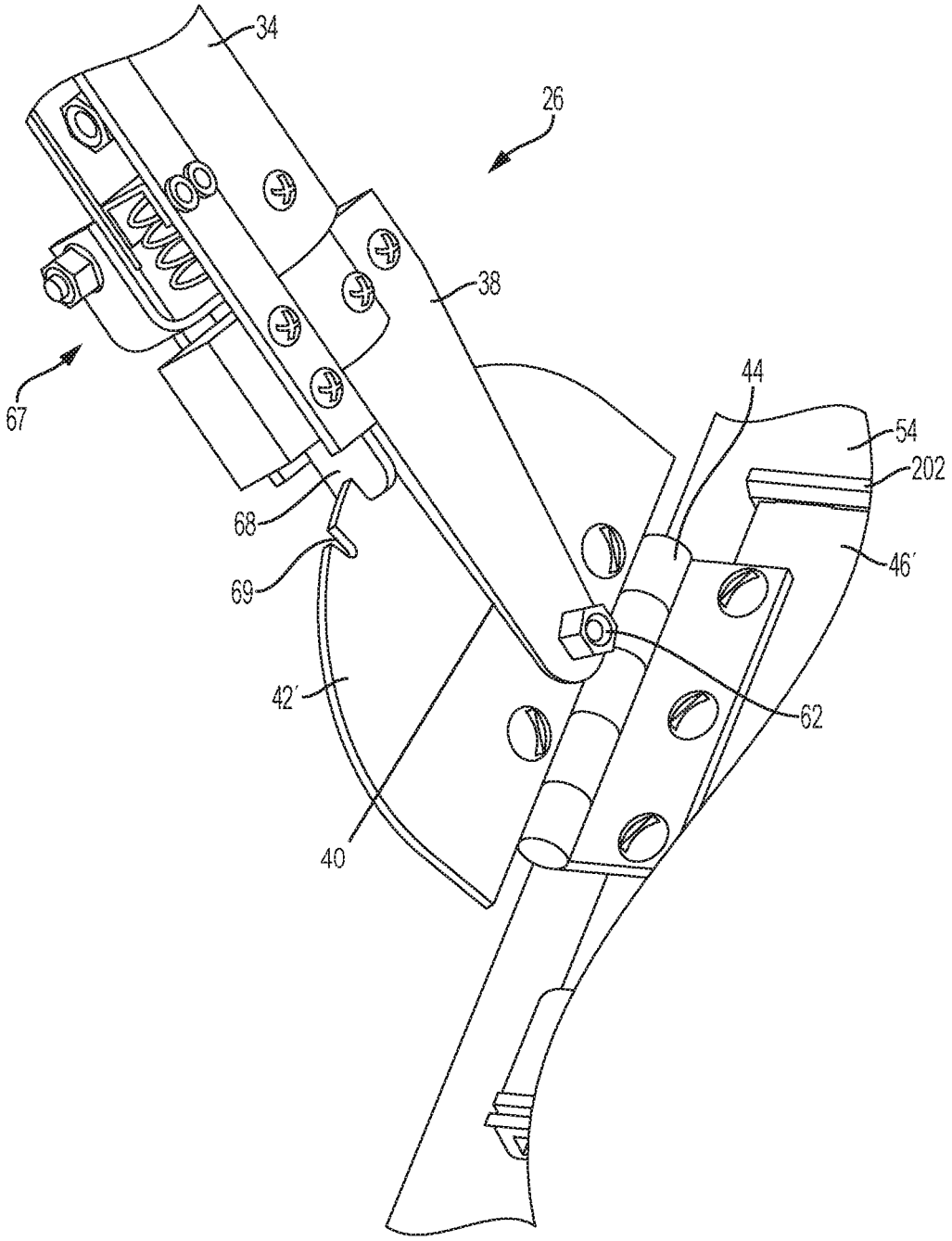
FIG. 4 is an enlarged perspective view of the pivot assembly of the handheld concrete finisher of FIG. 1.

In the illustrated embodiment, handle assembly 24 comprises a pair of telescoping shafts or shaft assemblies 30, each having an upper end 72 and a lower end 34. Attached to each upper end 72 is handle or grip 36, which the operator uses to grasp and maneuver finisher 20. As best seen in FIG. 4, the lower end 34 of shaft 30 has a generally Y-shaped bracket 38 having a slot 40 for receiving semicircular disc 42' of pivot assembly 26. Bracket 38 pivotally attaches generally at the center of semicircular disc 42' so that handle assembly 24 may pivot forward and backward about an axis X that extends generally laterally relative to an operator or an operator orientation when using finisher assembly 20. Attached near the bottom of disc 42' is a butt hinge 44.

In addition to the adjusting the rotational position of handle assembly 24 relative to finishing tool 22, the length of handle assembly 24 is also adjustable, allowing the operator to finish concrete from an upright or standing position or to extend the reach of the operator. As best shown in FIG. 1, handle assembly 24 includes a pair of telescoping shafts 30 that allow the operator to set the length of handle assembly 24 to a desired operating position. Each shaft 30 includes an inner shaft 70, which inserts into a hollow outer tube 72. Inner shaft 70 is configured to extend or retract in tube 72, changing the length of shaft 30. Tube 72 includes a plurality of apertures 76 generally equally spaced along its length. A spring loaded button or protrusion in shaft 70 is configured to snap engage aperture 76 setting shaft 30 to a desired length.

Handle assembly 24 further includes a telescoping crossbar 80 that allows the operator to set the horizontal spacing between handles 36. Crossbar 80 extends between shafts 30 just below handles 36 and includes an inner shaft 82 inserted into a hollow outer tube 84. Inner shaft 82 is configured to extend or retract in tube 84, changing the horizontal spacing between handles 36. Like tube 72, tube 84 includes a plurality of generally equally spaced apertures along its length. A spring loaded button or protrusion in shaft 82 is configured to snap engage one of the apertures setting the length of crossbar 80.

As illustrated, finishing tool 22 is a flat tool used to give the concrete a smooth surface. However, finishing tool 22 may be any one of a number of tools in any number of different sizes used for finishing concrete such as a trowel, edger or the like. The interchangeability of the finishing tool allows a single handheld finisher 20 to be used throughout the entire concrete finishing process. It should be appreciated that alternative connections or connectors may be employed to secure a tool to the pivot assembly and/or handle assembly. Additionally, the width of tool bracket 46' and/or the lateral spacing of pivot assembly 26 may change, such as based on the size and type of attached finishing tool 22. For example, a wider or narrower tool bracket may be provided, such as, for example, a tool bracket used with the edging tool may be wider than the tool bracket used with the float tool. Optionally, a tool bracket having an adjustable width and/or having multiple laterally spaced pivot assembly mounting points or the like may be used.

An additional embodiment of the concrete finisher assembly (not shown) includes the detachable concrete finishing tool, the handle assembly, the pivot assembly, and a control mechanism. Pivot assembly attaches between finishing tool and handle assembly and allows an operator to pivot handle assembly both side-to-side and backward and forward relative to the finishing tool. When the operator has found a desired working position, the operator may engage the control mechanism that control braking mechanisms. While the control mechanism is engaged, handle assembly is prevented from rotating backward or forward relative to finishing tool while still allowing side-to-side rotation as finishing tool moves across the surface of the concrete. This enables the operator, for example, to maintain a desired orientation and apply force to finishing tool while limiting the pivotal movement of handle assembly relative to the finishing tool. As the operator works the concrete surface, the control mechanism may be continually engaged and disengaged by the operator to adjust the forward or backward positioning of handle assembly in order to keep finishing tool generally flat against the concrete surface. The length of handle assembly is adjustable, allowing the operator to comfortably stand while using finisher assembly and/or to extend the reach of the operator. The detachable finishing tool allows the operator to use different tools throughout the concrete finishing process.

The backward and forward pivoting of handle assembly about axis X may be controlled via control mechanism. Control mechanism comprises hand operated control lever connected with a pair of braking mechanisms associated with each shaft, and cables connecting lever to the braking mechanisms. The lever is located on or near handle, allowing for ease of control by the operator. Braking mechanisms are located at the lower ends of handle assembly near each of the brackets 38 and includes a first and second brake arm and configured to rotate about a mounting fastener. Attached to each arm is a brake pad. When the operator has selected the desired working position, the operator may engage lever, pulling cable and causing brake arms to rotate inward about fastener, clamping brake pads against discs, which prevents the pivoting of handle assembly about axis X. This allows the operator to apply force to finishing tool without having handle assembly rotate. As the operator moves the finishing tool across the concrete surface, lever may be released so the rotation of handle assembly about axis X may be readjusted to a new position. Although shown with two brake mechanisms, finisher assembly may alternatively be constructed with a single brake mechanism.

When the operator engages the control mechanism, handle assembly is prevented from rotating backward or forward relative to finishing tool while still allowing side-to-side rotation as finishing tool moves across the surface of the concrete. This enables the operator, for example, to maintain a desired orientation and apply force to finishing tool while limiting the pivotal movement of handle assembly relative to the finishing tool. As the operator works the concrete surface, control mechanism may be continually engaged and disengaged by the operator to adjust the forward or backward positioning of handle assembly in order to keep finishing tool generally flat against the concrete surface.

In a further embodiment (not shown) the assembly utilizes an alternative finishing tool comprising an edging tool. The handle assembly attaches to the finishing tool via a mounting bracket. Optionally, the finishing tool may be configured to mount directly to the handle assembly. An alternative handheld concrete finisher or concrete finisher assembly may have a finishing tool, a handle assembly, a pivot assembly, and a control mechanism. Handle assembly and control mechanism have the same basic operation as handle assembly 20 and control mechanism 28 above such that a detailed discussion need not be repeated herein. Pivot assembly comprises a butt hinge having a semicircular disc on one side of a pivot pin and an L-shaped bracket on the other side. Similar to disc 42' above, disc attaches at the bottom of handle assembly and allows for forward and backward rotation of handle assembly about axis X. Bracket mounts directly to the top surface of finishing tool via a plurality of fasteners. Hinge provides rotation of handle assembly about axis Y. The finishing tool is thus an edging tool used for giving concrete a rounded edge. Optionally, finishing tool may be any one of a number of tools in any number of different sizes used for finishing concrete such as a float, trowel, or the like.

Additionally, the width of tool bracket 46' and/or the lateral spacing of pivot assembly 26 may change, such as based on the size and type of attached finishing tool 22. For example, a wider or narrower tool bracket may be provided, such as, for example, a tool bracket used with the edging tool may be wider than the tool bracket used with the float tool. Optionally, a tool bracket having an adjustable width and/or having multiple laterally spaced pivot assembly mounting points or the like may be used. Still further, the finishing tools may be connected in an alternative manner relative to the disclosed slots and tabs, including additional or fewer, or alternatively arranged tabs, or different shapes and slots.

Therefore, the present invention provides a handheld concrete finisher for preparing concrete from an upright or standing position. The finishing tool may be any one of a number of tools for preparing concrete and is detachable, allowing the operator to interchange tool attachments based on the job requirements. The handle assembly is capable of extending or retracting to adjust to the height of the operator and/or to extend the reach of the operator for enhanced ease of use.

Changes and modifications to the specifically described embodiments may be carried out without departing from the principles of the present invention, which is intended to be limited only by the scope of the appended claims as interpreted according to the principles of patent law including the doctrine of equivalents.

The embodiments of the invention in which an exclusive property is claimed are defined as follows:

1. A concrete finisher assembly comprising:

a removable concrete finishing tool; and a handle assembly;

wherein said handle assembly comprises a pair of elongate shafts with said concrete finishing tool being pivotally mounted at an end of said handle assembly via a multi-axis pivot assembly, and wherein said multi-axis pivot assembly comprises a pair of parallel hinges that define pivot axes in a first pivot direction, with each said hinge including a disc extending in the first pivot direction such that said discs are configured to pivot about the first pivot direction, and wherein said elongate shafts are pivotally mounted to separate ones of said discs such that said elongate shafts are configured to pivot in a second pivot direction with the second pivot direction being perpendicularly oriented relative to the first pivot direction, and wherein at least a first one of said discs includes a plurality of notches with said elongate shaft mounted to said first one of said discs including an extendable and retractable locking member configured to selectively engage within said notches, and wherein with said locking member engaged within a selected one of said notches said handle assembly is inhibited from pivoting in the second pivot direction; and wherein said elongate shafts include hand grips at ends distal from said multi-axis pivot assembly with said elongate shafts configured to enable a user of said concrete finisher assembly to stand while working concrete with said concrete finishing tool.

2. The concrete finisher assembly of claim 1, further including a pivot control mechanism for selectively extending and retracting said locking member.

3. The concrete finisher assembly of claim 2, wherein said pivot control mechanism includes a spring for biasing said locking member into a selectable one of said notches.

4. The concrete finisher assembly of claim 2, wherein said pivot control mechanism includes a cable operatively connected with said locking member and extending to a lever with said lever being disposed distally from said pivot assembly, and wherein said lever is configured to enable an operator to selectively extend and retract said locking member.

5. The concrete finisher assembly of claim 1, wherein a second one of said discs includes a plurality of notches with the said elongate shaft mounted to said second one of said discs including an extendable and retractable locking member configured to selectively engage within said notches of said second one of said discs.

6. The concrete finisher assembly of claim 5, wherein a first cable is operatively connected with said locking member that selectively engages with said first one of said discs and a second cable is operatively connected with said locking member that selectively engages with said second one of said discs, and wherein said first cable and said second cable extend to a lever disposed distally from said pivot assembly, and wherein said lever is configured to enable an operator to selectively extend and retract said locking members.

7. The concrete finisher assembly of claim 1, wherein said elongate shafts are connected together by a cross bar, with said cross bar being disposed distally from said pivot assembly, and wherein said cross bar spaces said elongate shafts from each other a greater distance relative to the connection of said elongate shafts with said discs whereby said elongate shafts and said cross bar define a triangular orientation.

8. The concrete finisher assembly of claim 7, wherein said elongate shafts comprise elongate telescoping shafts and said cross bar comprises a telescoping cross bar.

9. The concrete finisher assembly of claim 1, wherein said pivot assembly comprises a tool bracket and said concrete finishing tool comprises a mounting plate, with said tool bracket being releasably connectable with said mounting plate.

10. The concrete finisher assembly of claim 9, wherein said mounting plate includes opposed ends with each said end including a slot, and wherein said tool bracket includes opposed tabs, and wherein said tabs are configured to engage with said slots of said mounting plate to retain said finishing tool to said pivot assembly.

11. The concrete finisher assembly of claim 10, wherein one of said tabs of said tool bracket comprises a selectively movable tab that is configured to extend into one of said slots of said mounting plate.

12. The concrete finisher assembly of claim 11, wherein a tool release mechanism is mounted to said handle assembly to controllably move said movable tab, said tool release mechanism comprising a cable operatively connected to said movable tab and extending to a lever disposed distally from said tool bracket, and wherein said lever is configured to enable an operator to selectively extend and retract said movable tab.

13. The concrete finisher assembly of claim 12, further including a spring disposed on said tool bracket, said spring configured to bias said moveable tab into engagement with said one of said slots of said mounting plate.

14. A concrete finisher assembly comprising:

a removable concrete finishing tool;

a handle assembly, said handle assembly comprising a pair of elongate shafts;

a multi-axis pivot assembly disposed between said concrete finishing tool and said handle assembly with said concrete finishing tool being connected with said pivot assembly to enable said concrete finishing tool to pivot relative to said handle assembly, wherein said multi-axis pivot assembly comprises a pair of parallel hinges that define pivot axes in a first pivot direction, with each said hinge including a disc extending in the first pivot direction such that said discs are configured to pivot about the first pivot direction, and wherein said elongate shafts are pivotally mounted to separate ones of said discs such that said elongate shafts are configured to pivot in a second pivot direction with the second pivot direction being perpendicularly oriented relative to the first pivot direction, and wherein at least a first one of said discs includes a plurality of notches with said elongate shaft mounted to said first one of said discs including an extendable and retractable locking member configured to selectively engage within said notches, and wherein with said locking member engaged within a selected one of said notches said handle assembly is inhibited from pivoting in the second pivot direction; and a pivot control mechanism for selectively extending and retracting said locking member, wherein said pivot control mechanism includes a cable operatively connected with said locking member and extending to a lever disposed distally from said pivot assembly, and wherein said lever is configured to enable an operator to selectively extend and retract said locking member;

wherein said elongate shafts are configured to enable a user of said concrete finisher assembly to stand while working concrete with said concrete finishing tool.

15. The concrete finisher assembly of claim 14, wherein said elongate shafts comprise elongate telescoping shafts, and wherein said handle assembly further includes a cross bar, with said cross bar extending between and connecting said elongate shafts together with said cross bar being disposed distally from said pivot assembly, and wherein said cross bar spaces said elongate shafts from each other a greater distance relative to the connection of said elongate shafts with said discs whereby said elongate shafts and said cross bar define a triangular orientation.

16. The concrete finisher assembly of claim 15, wherein said cross bar comprises a telescoping cross bar.

17. The concrete finisher assembly of claim 14, wherein said pivot assembly comprises a tool bracket and said concrete finishing tool comprises a mounting plate, with said tool bracket being releasably connectable with said mounting plate, and wherein said hinges are mounted to said tool bracket.

18. The concrete finisher assembly of claim 17, wherein said mounting plate includes opposed ends with each said end including a slot, and wherein said tool bracket includes opposed tabs, and wherein said tabs are configured to engage with said slots of said mounting plate to retain said finishing tool to said pivot assembly.

19. The concrete finisher assembly of claim 18, wherein one of said tabs of said tool bracket comprises a selectively movable tab that is configured to extend into one of said slots of said mounting plate.

20. The concrete finisher assembly of claim 19, wherein a tool release mechanism is mounted to said handle assembly to controllably move said movable tab, said tool release mechanism comprising a cable operatively connected to said movable tab and extending to a release lever disposed distally from said tool bracket, and wherein said release lever is configured to enable an operator to selectively extend and retract said movable tab.

* * * * *